US009545786B2

(12) United States Patent
Tang et al.

(10) Patent No.: US 9,545,786 B2
(45) **Date of Patent: *Jan. 17, 2017**

(54) ADVANCED METHOD FOR PRODUCING A ROLLER-COATING COLOR STEEL PLATE WITH MULTICOLORED PATTERNS

(71) Applicant: LIAONING CHAOSHUO TOMA TECHNOLOGY STEEL PLATE PRINTING CO., LTD., Yingkou, Liaoning (CN)

(72) Inventors: Yueping Tang, Yingkou (CN); Jianping Zhou, Yingkou (CN); Liang Wu, Yingkou (CN)

(73) Assignee: LIAONING CHAOSHUO TOMA TECHNOLOGY STEEL PLATE PRINTING CO., LTD., Yingkou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/775,238

(22) PCT Filed: Jun. 28, 2013

(86) PCT No.: PCT/CN2013/078390

§ 371 (c)(1),
(2) Date: Nov. 2, 2015

(87) PCT Pub. No.: WO2014/139246

PCT Pub. Date: Sep. 18, 2014

(65) Prior Publication Data

US 2016/0052257 A1 Feb. 25, 2016

(30) Foreign Application Priority Data

Mar. 13, 2013 (CN) ..... 2013 1 0079518

(51) Int. Cl.
*B41F 23/08* (2006.01)
*B41J 29/38* (2006.01)
(Continued)

(52) U.S. Cl.
CPC ..... *B41F 23/08* (2013.01); *B05D 1/28* (2013.01); *G03G 15/266* (2013.01)

(58) Field of Classification Search
CPC ..... B41F 23/08
See application file for complete search history.

(56) References Cited

U.S. PATENT DOCUMENTS

RE25,134 E * 3/1962 Kinzelman ..... B41F 13/02 101/178
3,593,663 A * 7/1971 Vischulis ..... B41F 9/1036 101/157

(Continued)

FOREIGN PATENT DOCUMENTS

CN 101406874 A 4/2009
CN 101912839 A * 12/2010 ..... B05D 5/06

(Continued)

OTHER PUBLICATIONS

Dec. 12, 2013 Search Report issued in International Patent Application No. PCT/CN2013/078390.

*Primary Examiner* — Daniel J Colilla
*Assistant Examiner* — Ruben Parco, Jr.
(74) *Attorney, Agent, or Firm* — Oliff PLC

(57) ABSTRACT

A method for producing color steel plate with multicolored patterns, the PLC control module of servo control system collects the process and rotation speed of each roller of the roller coating unit, calculates out and makes the theoretical roller surface linear velocity be consistent with the process rotation speed; conversely, the actual roller surface linear velocity of each roller of roller coating unit is collected by (Continued)

servo control module having an encoder, and the signal of actual roller surface linear velocity is input into the PLC control system, so that PLC control system can compare actual and theoretical roller surface linear velocity, and adjust current frequency until actual and theoretical roller surface linear velocity are consistent. Control method ensures actual roller surface linear velocity is consistent with process rotation speed, so there is no need to stop the line for adjusting in the production process, thus increasing the production efficiency.

5 Claims, 2 Drawing Sheets

(51) Int. Cl.
*G03G 15/26* (2006.01)
*B05D 1/28* (2006.01)

(56) References Cited

U.S. PATENT DOCUMENTS

| | | | | |
|---|---|---|---|---|
| 3,605,615 | A * | 9/1971 | Huck | B41F 9/04 101/153 |
| 8,311,421 | B2 | 11/2012 | Handa | |
| 2008/0173195 | A1* | 7/2008 | Vidaillac | B41F 13/025 101/142 |
| 2009/0274473 | A1 | 11/2009 | Handa | |
| 2012/0039640 | A1 | 2/2012 | Kang | |

FOREIGN PATENT DOCUMENTS

| | | | |
|---|---|---|---|
| CN | 103029502 | A | 4/2013 |
| CN | 103158415 | A | 6/2013 |
| JP | 2000-047547 | A | 2/2000 |
| JP | 2009-294641 | A | 12/2009 |
| KR | 20120016477 | A | 2/2012 |

* cited by examiner

ADVANCED METHOD FOR PRODUCING A ROLLER-COATING COLOR STEEL PLATE WITH MULTICOLORED PATTERNS

FIELD OF INVENTION

The present invention relates to a method for producing color steel plate, belonging to the field of color steel plate manufacturing.

BACKGROUND OF THE INVENTION

Colored coating steel plate (commonly known as color steel plate) refers to that a metal substrate is treated by surface pretreatment prior to painting such as surface degreasing treatment and surface passivating treatment through a continuous unit, and then is coated with one-layer or multilayer of organic coatings on the surface, thus forming a composite material.

In order to coat multicolored patterns, the color of coating is required to be changed for several times a day for a majority of coating production line, and in order to realize the purpose of non-stop production, non-decrease yield and quick color change, generally two devices for fine coating are arranged at the front position of coating layer of the machine for fine coating of the processing line, wherein, device 1 is a single-head device for fine coating, and device 2 is a dual-head device for fine coating, which is arranged under machine 1, and when one device for fine coating coats a strip steel, the other one prepares for printing the next color, however, the above processing line is lack of a positioning system used for determining a relative position of various colors, which is just used for coating a regular pattern, but cannot produce an irregular one.

The applicant invented an intaglio printing machine using roller coating type for producing color steel plate with multicolored patterns by repeated studies, and the intaglio printing machine comprises a feeding equipment, used for providing paints; a suction roller, whose circumferential surface is in connection with the feeding equipment, and has a plurality of recesses adapted for being filled with paints for forming an image area; and a rubber coating roller, with its circumferential surface in connection with the suction roller, and used for receiving and transferring the image area formed by the paints on the coating roller onto a steel plate to form desired multicolored patterns.

However, during the process of using the intaglio printing machine, the applicant found out that the roller surface linear velocity of the suction roller and the rubber coating roller are frequently inconsistent with the process speed of the whole production line, and the whole production line is lack of a control system for on-line adjusting the rotation speed of the suction roller and the rubber coating roller, so the whole production line has to be stopped for adjustment after operation for a period of time, thus affecting the efficiency of the whole production line. If the production line is not stopped for adjustment, the steel strip transporting speed would be inconsistent with the roller surface linear velocity of each roller, thus frequently causing the steel strip unable to be coated at a designated position thereof. Besides, in order to print multicolor patterns, a plurality of roller coating units are required for coordinated operation. However, the above mentioned intaglio printing machine in the prior art is lack of a control system for allowing a continuous production between adjacent roller coating units, so workers need observe by human eyes if a first roller coating unit has completed coating of one color, and if yes, an adjacent roller coating unit will be started manually, thus it is unable to realize a continuous production between the adjacent roller coating units. At the same time, due to lack of the control system for adjusting the speed of the suction roller and the coating roller, it is unable to realize error revision when misplacement occurs between the patterns printed by the adjacent roller coating units.

SUMMARY OF THE INVENTION

Therefore, a first technical problem to be solved by the present invention is to provide an advanced method for producing color steel plate with multicolored patterns, by which the rotation speed of each roller of a roller coating unit is able to be adjusted to be consistent with the rotation speed of the process, thus improving the production efficiency.

A second technical problem to be solved by the present invention is to provide an advanced method for continuously producing color steel plates with multicolored patterns on the processing line of adjacent roller coating units.

A third technical problem to be solved by the present invention is to provide an advanced method for producing color steel plate with multicolored patterns which are lifelike and complete, because it is able to conduct error revision when misplacement occurs between the patterns.

In order to solve at least one of the above mentioned technical problems, in a class of embodiments, the present invention provides an advanced method for producing color steel plate with multicolored patterns, comprises the following process steps in sequence: A. preparing a steel strip to be printed; B. performing a pre-processing on the steel strip to be printed; C. using a first roller coating unit to perform a first roller coating transfer on the steel strip to be printed; D. using a second roller coating unit to perform a second roller coating transfer on the steel strip to be printed after a preset time; E. performing a post-processing to spray the steel strip with gloss paint; wherein in the step C, a servo control system is used to control the first roller coating unit, and the servo control system has a following control process of S1. inputting data of diameter of each roller and a process speed of the first roller coating unit into a PLC control module, then calculating out theoretical roller surface linear velocity of each roller by the PLC control module according to the process speed and the diameter of each roller, allowing the theoretical roller surface linear velocity of each roller to be consistent with the process speed, and outputting the calculated theoretical roll surface linear velocity signal of each roller into a servo control module having an encoder; S2. receiving the theoretical roll surface linear velocity signal of each roller by the servo control module from the PLC control module and driving each roller according to the theoretical roll surface linear velocity signal; S3. collecting actual roller surface linear velocity of each roller by the encoder and outputting the actual roller surface linear velocity signal of each roller into the PLC control module; S4. according to the received actual roller surface linear velocity signal and theoretical roller surface linear velocity signal of each roller, adjusting current frequency of electrical machine for driving each roller and adjusting the actual roller surface linear velocity of each roller to be consistent with the theoretical roller surface linear velocity of each roller by the PLC control module, thereby completing the roller coating transfer of the first roller coating unit.

In a class of this embodiment, in the sub-step S1 of step C, data of distance between the first roller coating unit and the second roller coating unit is input into the PLC control module, and on the basis of the process speed and the data of distance, the PLC control module calculates out a time to start the second roller coating unit, and starts the second roller coating unit according to the time, and then the second roller coating transfer of the second roller coating unit is completed.

In a class of this embodiment, after the sub-step S4 of step C, the printed patterns are collected by a code recognition module, and a pattern misplacement distance is determined by computer recognition, and then the process speed of the corresponding roller coating unit is revised.

In a class of this embodiment, the pre processing comprises in sequence the following steps of degreasing treatment, cleaning treatment, first drying treatment, passivating treatment and second drying treatment.

In a class of this embodiment, after the second drying treatment, the steel strip to be printed is treated in sequence by coating primer paint treatment, baking for curing treatment, and first cooling treatment.

In a class of this embodiment, in the step E, after fine coating with gloss paint, a third drying treatment is performed, followed by a second cooling treatment.

In a class of this embodiment, a recoiler is used to coil the steel strip after completing all the roller coating transfer.

In a class of this embodiment, the roller coating unit used in the step C and the step D comprises a feeding equipment used for providing paints; a suction roller, whose circumferential surface is in connection with the feeding equipment and has a plurality of recesses adapted for being filled with paints for forming an image area; a rubber-coating roller, with its circumferential surface in connection with the suction roller, used for receiving and transferring the image area formed by the paints on the coating roller onto a steel plate; a first scraper, arranged on a first scraper support and contacting with the suction roller at a specific angle, used for scraping off paints outside the image area on the suction roller; and a second scraper, arranged on the second scraper support and contacting with the coating roller at a specific angle, used for scraping off paints outside the image area on the rubber coating roller.

In a class of this embodiment, the first scraper contacts with the suction roller at an angle less than 30 degrees and the second scraper contacts with the coating roller at an angle more than 30 degrees.

In a class of this embodiment, the scraper support and the second scraper support respectively have a supporting base with the height and angle adjustable.

The advanced method for producing a roller-coating color steel plate with multicolored patterns of present invention providing has advantages as bellow:

1. In the advanced method for producing a roller-coating color steel plate with multicolored patterns of the present invention, for the first transfer, on one hand, the PLC control module of the servo control system collects the process speed and the rotation speed of each roller of the roller coating unit, calculates out the theoretical roller surface linear velocity and makes the theoretical roller surface linear velocity be consistent with the process rotation speed; on the other hand, the actual roller surface linear velocity of each roller of the roller coating unit is collected by a servo control module having an encoder, and the signal of the actual roller surface linear velocity is input into the PLC control system, so that the PLC control system can compare the actual roller surface linear velocity with the theoretical roller surface linear velocity, and adjust current frequency until the actual roller surface linear velocity is consistent with the theoretical roller surface linear velocity. In the above mentioned control method, the actual roller surface linear velocity is adjusted to be consistent with the theoretical roller surface linear velocity which is consistent with the process speed, thus ensuring that the actual roller surface linear velocity is consistent with the process rotation speed, so there is no need to stop the line for adjusting in the production process, thus increasing the production efficiency.

2. In the advanced method for producing a roller-coating color steel plate with multicolored patterns of the present invention, the data of distance between the first roller coating transfer unit and the second roller coating transfer unit is also input into the PLC control module, and on the basis of the process speed and the data of distance, the PLC control module is able to calculate out a preset time to start the second roller coating transfer unit. Once the production line is determined, the distance between adjacent units can be determined. The data of distance is input into the PLC control module in advance, and then according to the process speed and data of distance, the PLC control module calculates out the preset time to start next roller coating unit. Then the preset time to start next roller coating unit is able to be preset, and the next roller coating production line is allowed to be started within the preset time, so a continuous production between the adjacent roller coating units is realized, and the production efficiency is further improved.

3. The advanced method for producing a roller-coating color steel plate with multicolored patterns of the present invention further comprises a code recognition module. The printed pattern is collected by the code recognition module, and the pattern misplacement distance is determined by computer recognition, and then the process speed of the corresponding roller coating unit is revised. After next roller coating production line is started and the second transfer is completed, the printed pattern is collected by the code recognition module and the pattern misplacement distance is determined by the computer recognition, and then the rotation speed of each roller is revised in accordance with the pattern misplacement distance, so that the pattern misplacement can be revised. The above process can be circularly performed, hence ensuring lifelike and complete printed patterns. In addition, the length of the printed patterns is extended greatly by using the code recognition module.

4. In the advanced method for producing a roller-coating color steel plate with multicolored patterns of the present invention, prior to the first roller coating transfer, the pre processing comprises in sequence the following steps of degreasing treatment, cleaning treatment, first drying treatment, passivating treatment and second drying treatment, and then the steel strip to be printed is treated in sequence by coating primer paint treatment, baking for curing treatment, and first cooling treatment. The above processing steps effectively increase the adhesive force between the paints and the steel strip to be printed during the roller coating process and improve the formability of the color steel plate in later stage.

BRIEF DESCRIPTION OF THE DRAWINGS

In order to make the present invention more easily and clearly understood, the invention is further described below in conjunction with the detailed embodiments and the drawings, wherein.

Figure 1:
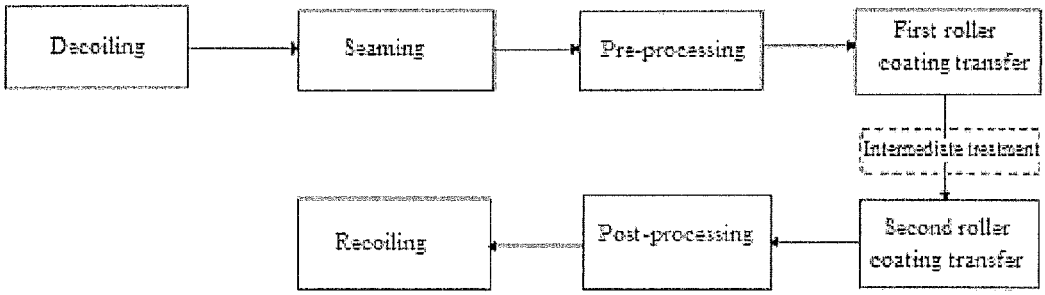
FIG. 1 is a flow chart of a method of producing a color steel plate with multicolored patterns of the present invention.

The reference numbers in the drawings represent:

1—feeding equipment; 2—suction roller; 3—rubber coating roller; 4—first scraper; 5—second scraper; 6—cleaning device; 61—liquid feed tank; 62—transfer pump; 63—transfer pipe; 64—spay pipe; 65—spay hole; 67—recovery tank; 68—filter; 7—support roller

DETAILED DESCRIPTION OF THE EMBODIMENTS

Embodiment 1

Figure 3:
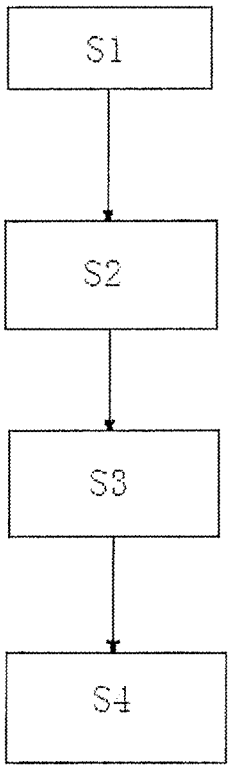
FIG. 3 is a workflow chart of a servo control system provided by the present invention.

As shown in FIG. 1, this embodiment provides a method of producing a color steel plate with multicolored patterns, comprising the following process steps in sequence:

A. preparing a steel strip to be printed, wherein, using an decoiler to decoil and trim the steel strip and using a seamer to seam the decoiled steel strip; B. performing a pre-processing on the steel strip to be printed; C. using a first roller coating unit to perform a first roller coating transfer on the steel strip to be printed; D. using a second roller coating unit to perform a second roller coating transfer on the steel strip to be printed after a preset time; E. performing a post-processing to spray the steel strip with gloss paint; in the step C, a servo control system is used to control the first roller coating unit, and the servo control system has the following control process of as shown in FIG. 3:

S1. inputting data of diameter of each roller and a process speed of the first roller coating unit into a PLC control module, then calculating out theoretical roller surface linear velocity of each roller (theoretical rotation speed=process speed/π*diameter of each roller, theoretical roller surface linear velocity=theoretical rotation speed*roller diameter*π) by the PLC control module according to the process speed and the diameter of each roller, allowing the theoretical roller surface linear velocity of each roller to be consistent with the process speed, and outputting the calculated theoretical roll surface linear velocity signal of each roller into a servo control module having an encoder S2. receiving the theoretical roll surface linear velocity signal of each roller by the servo control module from the PLC control module and driving each roller according to the theoretical roll surface linear velocity signal;

S3. collecting actual roller surface linear velocity of each roller by the encoder and outputting the actual roller surface linear velocity signal of each roller into the PLC control module;

S4. according to the received actual roller surface linear velocity signal and theoretical roller surface linear velocity signal of each roller, adjusting current frequency of electrical machine for driving each roller and adjusting the actual roller surface linear velocity of each roller to be consistent with the theoretical roller surface linear velocity of each roller by the PLC control module, thereby completing the roller coating transfer of the first roller coating unit.

In the present embodiment, in order to realize continuous operation of adjacent roller coating units on line, in the sub-step S1, data of distance between the first roller coating unit and the second roller coating unit is input into the PLC control module, and on the basis of the process speed and the data of distance, the PLC control module calculates out a time to start the second roller coating unit, and starts the second roller coating unit according to the time, and then the second roller coating transfer of the second roller coating unit is completed.

In the present embodiment, in order to print irregular long patterns, after completing the printing of the second roller coating unit, that is, after the step S4, the printed patterns are collected by a code recognition module, and the pattern misplacement distance is determined by a computer recognition system, and then the process speed of the corresponding roller coating unit is revised. The revision process is described in detail as below. If a misplacement distance between the actual position of a latter printed color in the patterns and the predetermined position of the latter printed color, relative to the former printed color, is collected by the code recognition module, for example, the actual position locates 10 mm ahead of the predetermined position, which indicates that the actual process speed (denoted by V1) of the roller delivering the steel strip speeds up 10 mm per unit time relative to the theoretical process speed (denoted by V2), that is at this time, V2=V1−10, thus calculating out V2. Then the calculated V2 is converted into the theoretical rotation speed of the roller (denoted by N) via the formula N=V2/π*roller diameter, thereby adjusting the current frequency of the corresponding electric machine in accordance with rotation speed N, thus the rotation speed of the corresponding roller will be adjusted, and the process speed will be further adjusted, and finally the pattern misplacement accuracy is controlled within ±0.6 millimeter. This adjusting process is a dynamic and repeated process. Herein, the printed patterns are collected by a digital video comprised in the code recognition module.

In order to improve the adhesive force between the paints and the steel strip and the formability of the printed steel strip, the present embodiment comprises a step of pre-processing the steel strip before transferring, and the pre-processing before transferring comprises the following steps in sequence: in the degreasing treatment, an alkali liquor with an concentration of 1% and an temperature of 50-65 degrees is used to perform degreasing so as to remove oil and dust from the surface of the strip steel, and in the alkali liquor, the ratio of total alkali to free alkali is less than 2.5; in the cleaning treatment, desalted water having a temperature of 50-65 degrees and a PH value less than 7.8 is used to wash the surface of the strip steel after degreasing treatment, so as to remove residual alkali liquor on surface of the strip steel; in a first drying treatment, hot air having a temperature of 75-85 degrees heated by a vapor heat exchanger is used to dry the surface of the strip steel after cleaning so as to remove residual water thereon; in the passivating treatment, the surface of the strip steel after cleaning is passivated with a treating solution having Chromium weight of 22-32, so as to increase the adhesion force between the strip steel and the primer paint and also increase the antiseptic property; in a second drying treatment, the passivated surface is dried by an electrical heating oven at a baking temperature of 75-85 degrees, in order to enhance passivation effect. In the coating primer paint treatment, the first roller coating unit is used to coat primer paint and back paint on the surface of the strip steel, and the color and the property of the primer paint depend on the patterns to be printed; in the baking for curing treatment and first cooling treatment, the strip steel coated with the primer paint and the back paint is baked to allow the primer paint and the back paint to be fully dried at temperature of 214-232 degrees, then the strip steel is cooled by water spay and flow to further stabilize the property of the primer paint and the back paint.

In the present embodiment, in order to improve brightness of the patterns and protection for the pattern, a post processing treatment is performed to the steel strip, and the post processing treatment comprises steps of spraying gloss paint on the surface of the steel strip, and then performing a third drying treatment, followed by a second cooling treatment.

In the present embodiment, in order to let the produced steel strip be convenient for storage and transport, a recoiler is used to coil the steel strip after completing all the roller coating transfer.

In the present embodiment, after the first roller coating transfer and after the first roller coating transfer, it further comprises a step of intermediate treatment which is drying and cooling treatment, and it should be noted that, the intermediate treatment should be ensured to complete before starting the second roller coating unit, alternatively, the time of performing the intermediate treatment is taken into consideration when calculating out the preset time to start the second roller coating unit, thereby revising the starting time of the second roller coating unit.

It should be noted that, for the production method of the above color steel plate with multicolored patterns of the present invention, roller coating units are required for carrying out the step B and the step C, but there is no limitation to the specific structure of the roller coating units.

It should be noted that, the present embodiment provides a method for producing a color steel plate with two colored patterns, which requires two roller coating units. While on the basis of the production method of the present embodiment, in particular of the techniques for adjusting rotation speed, time for starting the second roller coating unit, and the code recognition in the servo control system, modifications can be made by those skilled in the art so as to produce color steel plate with patterns in three-, four-, five- or more colors.

Embodiment 2

Figure 2:
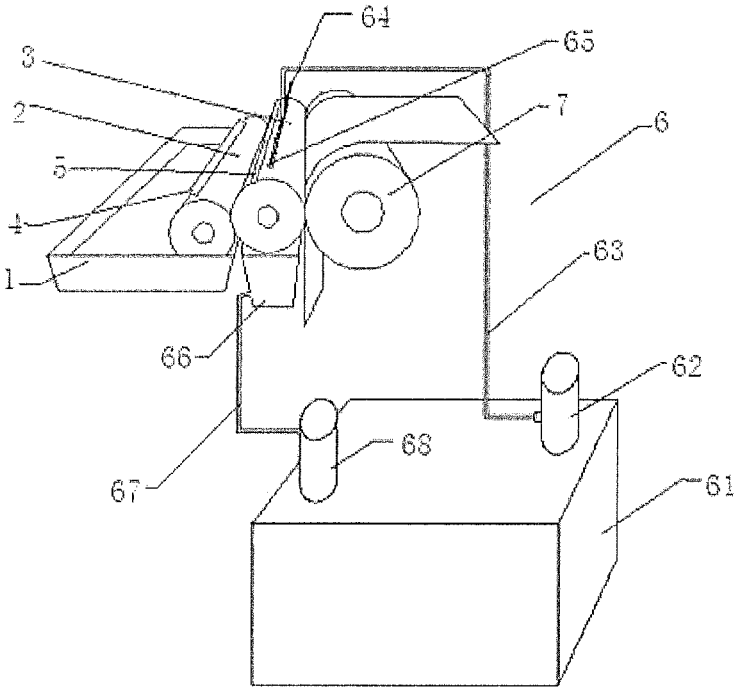
FIG. 2 is a schematic view of a roller coating unit of the present invention.

The present embodiment provides a structure of the roller coating unit used in the steps B and C in the embodiment 1. As shown in FIG. 2, the roller coating unit comprises a feeding equipment 1 used for providing paints; a suction roller 2, whose circumferential surface is in connection with the feeding equipment 1, and has a plurality of recesses adapted for being filled with paints for forming an image area; a rubber-coating roller 3, with its circumferential surface in connection with the suction roller 2, used for receiving and transferring the image area formed by the paints on the coating roller 3 onto a steel plate; a first scraper 4, arranged on a first scraper support and contacting with the suction roller 2 at a specific angle, used for scraping off paints outside the image area on the suction roller 2; and a second scraper 5, arranged on the second scraper support and contacting with the coating roller 3 at a specific angle, used for scraping off paints outside the image area on the rubber coating roller 3.

The working process of the roller coating unit in the present embodiment is described as below. When the suction roller 2 runs, the feeding equipment 1 supplies the suction roller 2 with paints. A part of the paints gets into the recesses used for forming an image area on the suction roller 2, and another part of the paints locates outside the recesses on the suction roller 2. The paints outside the recesses on the suction roller 2 is scraped off by the first scraper 4, then the suction roller 2 rotates to transfer the paints in the recesses onto the rubber-coating roller 3 to form an image area. Then the paints outside the image area on the rubber coating roller 3 is scraped off by the second scraper, then the rubber coating roller 3 rotates to transfer the image area onto the metal plate to be printed to form a pattern. The metal plate to be printed is supported by a support roller 7 which also provides a supporting force for the coating operation of the rubber coating roller.

The present embodiment provides a method of producing color steel plate with multicolored patterns as follows:

A. preparing a steel strip to be printed, wherein, using a decoiler to decoil and trim the steel strip and using a seamer to seam the decoiled steel strip;

B. performing a pre-processing on the steel strip to be printed;

C. using a first roller coating unit to perform a first roller coating transfer on the steel strip to be printed;

D. using a second roller coating unit to perform a second roller coating transfer on the steel strip to be printed after a preset time;

E. performing a post-processing to spray the steel strip with gloss paint;

In the step C, a servo control system is used to control the first roller coating unit, and the servo control system has a following control process:

S1. inputting data of diameter of the suction roller 2 and the coating roller 3 and the process speed of the first roller coating unit into a PLC control module, then calculating out theoretical roller surface linear velocity of the suction roller 2 and the coating roller 3 by the PLC control module according to the process speed and the diameter of the suction roller 2 and the coating roller 3, allowing the theoretical roller surface linear velocity of the suction roller 2 and the coating roller 3 to be consistent with the process speed, and outputting the calculated theoretical roller surface linear velocity signal of the suction roller 2 into a first servo control module having a first encoder, and outputs the theoretical roller surface linear velocity signal of the coating roller 3 into a second servo control module having a second encoder;

S2. receiving the theoretical roller surface linear velocity signal of the suction roller 2 by the first servo control module from the PLC control module and according to the signal, driving the suction roller 2; receiving the theoretical roller surface linear velocity signal of the coating roller 3 by the second servo control module from the PLC control module and according to the signal, driving the coating roller 3;

S3. collecting the actual roller surface linear velocity of the suction roller 2 by the first encoder and outputting the actual roller surface linear velocity signal of the suction roller 2 into the PLC control module, and collecting the actual roller surface linear velocity of the coating roller 3 by the first encoder and outputting the actual roller surface linear velocity signal of the coating roller 3 into the PLC control module;

S4. according to the received actual roller surface linear velocity signal and the theoretical roller surface linear velocity signal of the suction roller 2 and the coating roller 3, adjusting current frequency of electrical machine for driving each roller and adjusting the actual roller surface linear velocity of the suction roller 2 and the coating roller 3 to be consistent with the theoretical roller surface linear velocity of the suction roller 2 and the coating roller 3 by the PLC control module, thereby completing the roller coating transfer of the first roller coating unit.

The rubber coating roller 3 of the roller coating unit of the present embodiment is made of rubber, and such a design of structure allows the rubber coating roller to flexibly contact with the suction roller 2 and the steel plate to be printed respectively, thus ensuring an exactly matching contact. In this way, the image area on the suction roller 2 can be completely transferred onto the rubber coating roller 3, and the image area on the rubber coating roller 3 can be completely transferred onto the steel plate to be printed, thus forming a complete image area. Moreover, the intaglio printing machine provided in the present embodiment comprises a first scraper 4 and a second scraper 5 (FIG. 1 is a schematic diagram showing the first scraper 4 in contact with the suction roller 2 and the second scraper 5 in contact with the rubber coating roller 3). The first scraper 4 is used to scrape off the paints outside the recesses on the suction roller 2, and the second scraper 5 is used to scrape off the paints outside the image area on the rubber coating roller 3, thus avoiding the defect of lower labor efficiency caused by manual scrape, thereby improving labor efficiency. In addition, the first scraper 4 and the second scraper 5 are contacting with the suction roller 2 and the rubber coating roller 3 at a specific angle respectively, which can ensure better effect of scraping and prolonging the service life of the scraper.

It should be noted that, the coating roller may also be made of other materials as well as rubber, as long as the materials can ensure normal coating and flexible contact with the suction roller and the steel plate to be printed, such as silicone products which can meet requirements for elasticity, hardness and transfer property during coating.

In the present embodiment, the first scraper 4 contacts with the suction roller 2 at an angle less than 30 degrees, and the second scraper 5 contacts with the coating roller 3 at an angle more than 30 degrees. During intaglio printing process, paints that need to be scraped off are located on different positions at a same moment, so the first scraper 4 and the second scraper 5 are set at different angles, thus ensuring paints on the suction roller 2 and the coating roller 3 can be scraped off at the same time.

In the present embodiment, the first scraper 4 is made from titanium steel plate and has a blade thickness of 0.3 mm, and the second scraper 5 is made from titanium steel plate and has a blade thickness of 0.3 mm.

In the present embodiment, in order to improve the properties of the roller coating unit, a cleaning device 6 is provided for cleaning the paints on second scraper 5 and the rubber coating roller 3. The cleaning device 6 comprises a liquid feed tank 61, a transfer pump 62 used for pumping the cleaning liquid in the liquid feed tank 61, a cleaning liquid transfer pipe 63 communicated with the cleaning liquid transfer pump 62, and a spay pipe 64 communicated with the cleaning liquid transfer pipe. The spay pipe 64 is arranged above the rubber coating roller 3 in the axial direction and has a plurality of spay holes 65 thereon. The cleaning device 6 further comprises a cleaning liquid recovery tank 66, arranged below the coating roller 3 and connected with a recovery pipe 67 leading to the liquid feed tank 61. A filter 68 is arranged between the recovery pipe 67 and the liquid feed tank 61.

The working process of the cleaning device 6 provided in the present embodiment is described as below:

The cleaning liquid in the liquid feed tank 61 is pumped to the spay pipe 64 by the transfer pump 62, and is sprayed through the spray holes 65, subsequently the cleaning liquid flows over the rubber coating roller 3 and flows into the recovery tank 66, then passes through the recovery pipe 67 and is filtered by the filter 68, and finally gets back to the liquid feed tank 61 for recycling.

In the present embodiment, the feeding equipment 1 is a tray with a groove.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

The invention claimed is:

1. An advanced method for producing a roller-coating color steel plate with multicolored patterns, comprising in sequence the following process steps of A. preparing a steel strip to be printed;

B. performing a pre-processing on the steel strip to be printed;

C. using a first roller coating unit to perform a first roller coating transfer on the steel strip to be printed;

D. using a second roller coating unit to perform a second roller coating transfer on the steel strip to be printed after a preset time;

E. performing a post-processing to spray the steel strip with gloss paint;

wherein, in the step C, a servo control system is used to control the first roller coating unit, and the servo control system has the following control process of S1. inputting data of a diameter of each of a plurality of first rollers and a process speed of the first roller coating unit into a PLC control module, then calculating out a theoretical roller surface linear velocity of the plurality of first rollers by the PLC control module according to the process speed and the diameter of each of the plurality of first rollers such that the theoretical roller surface linear velocity of the plurality of first rollers equals the process speed, and outputting the theoretical roller surface linear velocity of the plurality of first rollers into a servo control module having an encoder;

S2. receiving, with the servo control module, the theoretical roller surface linear velocity of the plurality of first rollers from the PLC control module and driving the plurality of first rollers according to the theoretical roller surface linear velocity;

S3, collecting an actual roller surface linear velocity of the plurality of first rollers by the encoder and outputting the actual roller surface linear velocity of the plurality of first rollers into the PLC control module;

S4. according to the actual roller surface linear velocity and the theoretical roller surface linear velocity of the plurality of first rollers, adjusting a current frequency of an electrical machine for driving the plurality of first rollers and adjusting the actual roller surface linear velocity of the plurality of first rollers to be equal to the theoretical roller surface linear velocity of the plurality of first rollers by the PLC control module, thereby completing a roller coating transfer of the first roller coating unit;

the first roller coating transfer and the second roller coating transfer are respectively used to print patterns on the steel strip to be printed;

in the sub-step S1 of step C, data of a distance between the first roller coating unit and the second roller coating unit is input into the PLC control module, and on the basis of the process speed and the data of the distance, the PLC control module calculates out a time to start the second roller coating unit, and starts the second roller coating unit according to the time, and then the second roller coating transfer of the second roller coating unit is completed;

after the sub-step S4 of step C, the patterns are collected by a code recognition module, and a pattern misplacement distance is determined by computer recognition, and then the process speed of one of the first roller coating transfer unit and the second roller coating transfer unit is revised.

2. The method of claim 1, wherein, the pre-processing comprises in sequence the following steps of a degreasing treatment, a cleaning treatment, a first drying treatment, a passivating treatment and a second drying treatment.

3. The method of claim 2, wherein, after the second drying treatment, the steel strip to be printed is treated in sequence by a coating primer paint treatment, baking for curing treatment, and a first cooling treatment.

4. The method of claim 3, wherein, in the step E, after fine coating with gloss paint, a third drying treatment is performed, followed by a second cooling treatment.

5. The method of claim 4, wherein, a recoiler is used to coil the steel strip after completing the first and second roller coating transfers.

* * * * *